US005158414A

United States Patent [19]

Kais et al.

[11] Patent Number: 5,158,414

[45] Date of Patent: Oct. 27, 1992

[54] RAIL ATTACHING DEVICE PERMITTING LONGITUDINAL RAIL DISPLACEMENT

[75] Inventors: Alfred Kais, Gambacher Weg; Erich Nuding, Hohekreusstrasse; Sebastian Benenowski, Liebigstrasse, all of Fed. Rep. of Germany

[73] Assignee: BWG Butzbacher Weichenbau GmbH, Butzbach, Fed. Rep. of Germany

[21] Appl. No.: 694,544

[22] Filed: May 2, 1991

[30] Foreign Application Priority Data

May 4, 1990 [DE] Fed. Rep. of Germany ..... 4014345

[51] Int. Cl.[5] ..... E01B 9/38; E01B 9/60; E01B 11/34

[52] U.S. Cl. ..... 238/292; 238/331; 238/336; 238/264

[58] Field of Search ..... 238/292, 293, 264, 310, 238/315, 125, 278, 283, 331, 332, 336–339, 349, 352, 347

[56] References Cited

U.S. PATENT DOCUMENTS

| | | | |
|---|---|---|---|
| 906,900 | 12/1908 | Kyle | 238/278 |
| 1,279,723 | 9/1918 | Liebmann | 238/347 |
| 1,355,814 | 10/1920 | Coleman | 238/292 |
| 1,390,489 | 9/1921 | Bowlby | 238/292 |
| 1,411,278 | 4/1922 | Jarvis | 238/262 |
| 1,439,087 | 12/1922 | Gallagher | 238/292 |
| 2,572,769 | 10/1951 | Schulze | 238/292 |
| 2,732,134 | 1/1956 | Taylor | 238/292 |
| 2,904,256 | 9/1959 | Devaney | 238/292 |
| 2,944,740 | 7/1960 | Burkhardt | 238/292 |
| 3,220,651 | 11/1965 | Mahood | 238/292 |
| 3,295,761 | 1/1967 | Marcin | 238/292 |
| 3,883,072 | 5/1975 | Newton | 238/310 X |
| 4,566,630 | 1/1986 | Keiper | 238/292 |
| 4,705,215 | 11/1987 | Eisenberg et al. | 238/349 X |
| 4,770,342 | 9/1988 | Farrell et al. | 238/292 X |
| 4,940,183 | 7/1990 | Rieger et al. | 238/292 X |
| 4,967,954 | 11/1990 | Von Lange | 238/310 |

FOREIGN PATENT DOCUMENTS

| | | |
|---|---|---|
| 343145 | 9/1990 | European Pat. Off. . |
| 16393 | 5/1904 | Fed. Rep. of Germany . |
| 472298 | 3/1929 | Fed. Rep. of Germany . |
| 1004214 | 3/1957 | Fed. Rep. of Germany . |
| 3115943 | 11/1982 | Fed. Rep. of Germany . |

*Primary Examiner*—Robert J. Spar
*Assistant Examiner*—Brian K. Dinicola
*Attorney, Agent, or Firm*—Beveridge, DeGrandi & Weilacher

[57] ABSTRACT

A rail attachment device which allows for longitudinal displacement of a rail. The rail attachment device includes a first element fixedly supported to a ribbed plate and having a vertical arm extending essentially parallel to the longitudinal direction of the rail. The rail attachment device also includes a second element which is connected to the web of the stock rail. Connecting elements connect the first element to the second element so as to allow for longitudinal shifting of the stock rail and second element with respect to the first element fixed to the ribbed plate. In one embodiment, the second element includes a web-plate fixed to the web of the stock rail by a bolt and a plate-like element connected to the web-plate and having longitudinally extending slots. The connecting elements pass through holes formed in the vertical arm and through the elongated slots. The connecting elements are preferably pretensioned so as to have the plate-like element shift with respect to the vertical arm upon reaching a predetermined longitudinal force. A step arrangement between the plate-like element and vertical arm also prevents vertical shifting between the two.

14 Claims, 2 Drawing Sheets

RAIL ATTACHING DEVICE PERMITTING LONGITUDINAL RAIL DISPLACEMENT

Figure 1:
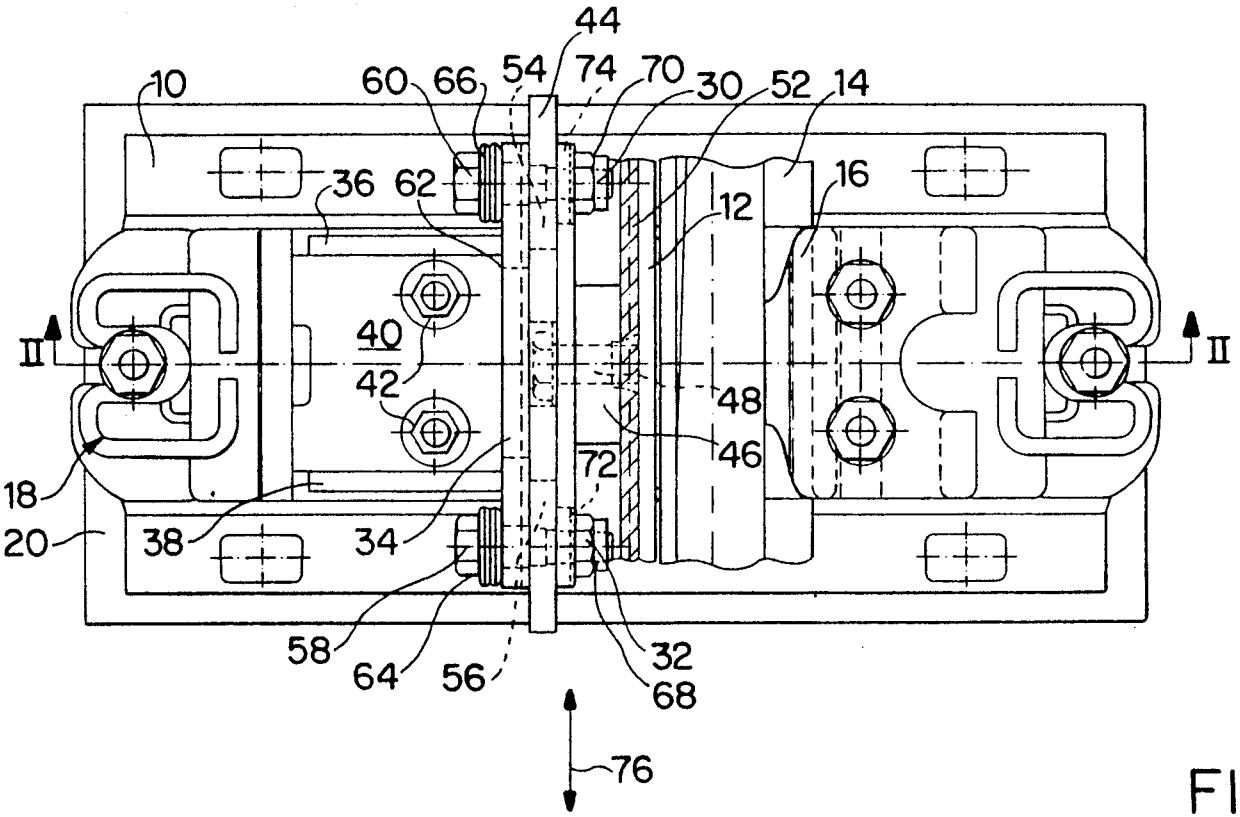

The present relates to means for securing rails, to connect a rail to a support, comprising a connecting system, that is connected, on the one hand, to the support, and on the other with the rail, this connecting system including at least one part that is connected to the support and a second part that is connected to the rail.

Rail securing means are intended to do the following: ensure that the track gauge is maintained; prevent the rail from tipping when acted on by lateral forces; prevent the rail from lifting away from the support; and to produce a track that is a stiff structure by the partial torsion-proof connection of the rails to the support.

Rail attachment means are also intended to ensure that the rail does not move longitudinally relative to the support. In order to compensate for changes in length that are caused by temperature variations, butt joints of various designs are used to join sections of rail together.

Feathered joints or rail expansion devices or dilation devices are known; in these, changes in length are balanced out in that the end of one rail is configured as a tongue rail and the other is configured as a stock rail. When this is done, the stock rail is connected rigidly to the support, such as a ribbed plate, which in its turn extends immoveably from a tie. The blade acts against the stock rail in such a way as to permit it to slide.

However, such joints may entail the disadvantage that in the event of large variations in length, in rails that are secured at great intervals, these will introduce forces into the support that the support can no longer accommodate so that it becomes loosened and/or shifted.

Butt joints are described, for example, in AT-B 16393 or DE-B 1004214.

It is the task of the present invention to so develop a rail securing means of the type described in the introduction hereto that when undesired forces occur in the longitudinal direction of the rail, which is to say when an undesired change in length occurs as a result of temperature variations, it is ensured that the support remains securely anchored.

Essentially, and according to the present invention, this task has been solved in that one of the parts incorporates at least one opening that extends in the longitudinal direction of the rail, through which a connecting element passes and by means of which the parts are frictionally connected such that the rail can move in the longitudinal direction of the rail relative to the support, to the extent that this is desired.

The concept of the present invention differs from known form locking designs in that on the occurrence of a force that runs in the longitudinal direction of the rail, and which could lead to loosening and shifting of the support and possibly a change in the shape of the rail, the rail can move longitudinally relative to the support so that, when used in particular in a rail expansion joint, the advantages achieved by this butt joint are retained.

In order to be able to state precisely the force above which a longitudinal displacement of the rail relative to the support, which is not in and of itself desired, may occur, a preferred embodiment of the invention foresees that the connecting element is supported relative to at least one part through at least one prestressed element, such as a disk spring. This provides an adjustment by simple means, so as to permit displacement once a previously established force is exceeded.

A particularly simple and thus a low-maintenance design results if the first part, which is connected to the support, includes an angular element with a vertical arm that runs approximately parallel to the web of the rail and the second part, which is connected to the rail, incorporates a plate-shaped element that runs parallel to the arm, and which preferably starts from a plate that is connected to the rail web. It is preferred that the plate-shaped element incorporate at least two slot-like openings, slots, or the like, that can start from the face of the element and through which pass the connecting elements that join the first part to the second part. The openings in the part, which do not incorporate the slot-like openings, are matched to the diameter of the shaft of the connecting elements used, such as screw-type elements. The elements, which are prestressed by springs are preferably located on the surface of the arm of the first part, which is connected to the support and which is remote from the rail.

In a second embodiment, the first and second parts fit in each other so as to be form locking, such that vertical shifting of the rail, which is to say in the direction of its principal axis, is precluded, which is to say that the rail cannot be raised. This form-locking interaction is effected preferably by way of step-like projections that fit in each other and start from the superimposed surfaces of the arm of the first part and from the plate-like element of the second part.

Further details, advantages, and features of the present invention are described not only in the claims but are described in greater detail, both signally and in combination, from the following description of an embodiment that is shown in the drawings appended hereto. These drawings show the following.

Figure 2:
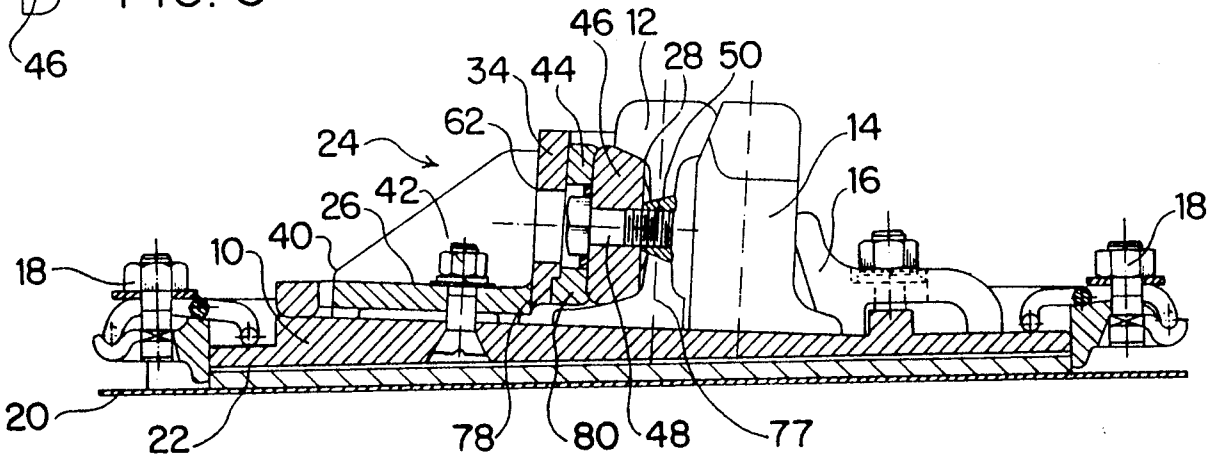

FIG. 1: a plan view of a section in the area of an expansion joint;

FIG. 2: a cross section on the line II—II in FIG. 1.

Figure 3:
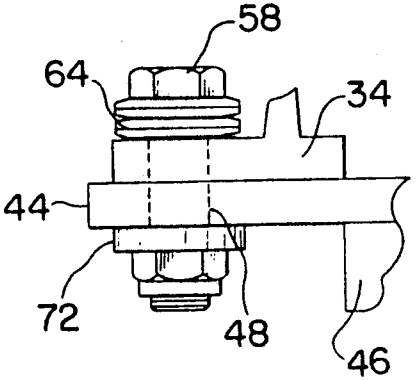

FIG. 3 a cut away portion of FIG. 1 except for the opening being formed in the first part instead of the second part.

The concept of the present invention is explained below, by way of example, using a rail expansion device. However, this is also suitable for other rail attachments.

A stock rail (12) and tongue rail (filled-section rail) (14) are arranged on a support, the latter being supported laterally by retaining elements (16) (not described in greater detail herein). This means that the switch rail (12) can move along the tongue rail (14) so as to compensate for changes in length caused by variation in temperature.

The ribbed plate (10) is connected rigidly by conventional attachment means (18) to, for example, a tie (20), when an insulating layer (22) or the like can be installed between the ribbed plate (10) and the tie (20).

The stock rail (12) is now connected to the ribbed plate (10) through a connecting system (24) configured according to the present invention. The connecting system consists of a first part (26) that is connected to the ribbed plate, a second part (28) that is connected with the stock rail (12) and connecting elements such as bolts (30) and (32) that connect the aforementioned parts to each other.

The first part (26) is preferably configured as an angle piece in which one arm (34) runs approximately parallel to the stock rail (12). Bolts (42) or similar elements pass through an arm (40) of the first part (26) that runs approximately parallel to the ribbed plate (10), this being done so as to secure the first part (26) to the ribbed plate (10).

In order to enhance stability, the arms of the angle piece can be connected through cheek pieces (36) and (38) that extend vertically.

The second part (28) that is connected to the stock rail (12) incorporates a plate-like element (44) that runs parallel to the vertical arm (34) of the first part (24), and this in its turn is connected to a web plate (46) through which passes a bolt (48) that connects the second part (28) with the web (54) of the stock rail (28).

In order to permit the stock rail (12) to move in a longitudinal direction (52) relative to the support, which is to say relative to the ribbed plate (10), the plate-like element (44) incorporates openings (54) and (56) that extend in the longitudinal direction (52) of the stock rail (28), and the connecting elements such as the bolts (30) and (32) pass through these. These connecting elements (30) and (32) also pass through the vertical arm (34) of the first part of the connecting system (24), to which end drillings that are matched to the diameter of the shaft of the connecting elements (30) and (32) are provided.

Between the head (58) or (60), respectively, of the connecting element (32) or (30), respectively, and the surface (62) of the arm (34) that is remote from the stock rail (12) there are spring elements such as sets of disk springs (64) or (66), respectively. The nuts (68) or (70), respectively, of the connecting elements (32) or (30), respectively, can abut on the surface of the plate-like element (44) that is proximate to the stock rail (12) or against spaces such as washers (72) and (74) that are arranged between these.

Because of the configuration of the connecting system (24) according to the present invention, it is possible that when an undesirable force acts on the stock rail (12) in the longitudinal direction (52) thereof, the stock rail (12) and connected web-plate (46) and plate-like element (44) move together; and longitudinally relative to the ribbed plate (10), which is to say in the direction indicated by the arrow (76). This is made possible by the fact that because of the openings (54), (56) in the plate-like element (44), which extend in the longitudinal direction (52) of the stock rail (12), movement is possible along the first part (24), which is to say parallel to the vertical arm (34), it being possible to determine when a corresponding displacement in the direction indicated by the arrow (76) will occur through prestressing of the disk springs (64), (66).

The connecting system (24) according to the present invention also ensures that the stock rail (12) cannot be raised in a vertical direction, which is to say parallel to the dashed line (77). To this end, the arm (34) incorporates a step (78) that interacts reciprocally with an associated step (80) in the plate-like element (44). As a consequence, the first and the second parts (26) and (28) fit in each other to form a shape fit such that although the stock rail (12) cannot be lifted away from the ribbed plate (10) it can move in its longitudinal direction (52).

What is claimed is:

1. A rial fastening device for fastening a longitudinally extending rail to a support, comprising:

a first element having securement means for fixedly securing said first element to the support and said first element having an arm extending off of the support;

a second element having connection means for fixedly connecting said second element to the rail and said second element having a plate member extending essentially parallel to said arm, and said plate member having an opening formed therein which is elongated in the longitudinal direction;

a connecting element which extends through the opening in said plate member and is joined with said arm so as to place said plate member and arm in frictional contact such that, upon an extension or contraction of the rail in the longitudinal direction and upon the section contact between said plate member and arm being overcome, said second element and the rail fixedly connected thereto are longitudinally displaced with respect to said first element which is fixedly secured to the support by said securement means.

2. A device according o claim 1, further comprising a prestressed element supported by said connecting element so as to permit longitudinal displacement of the rail upon a preestablished force being exceeded.

3. A device according to claim 2, wherein said prestressed element is at least one disk spring surrounding said shaft.

4. A device according to claim 1, wherein said opening is slot-shaped.

5. A device according to claim 4, wherein said second element has at least two slot-shaped openings.

6. A device according to claim 1, wherein said arm of said first element includes a stepped shoulder and said second element included a stepped shoulder which is engaged so as to prevent the rail from being lifted.

7. A rail fastening device as recited in claim 1, wherein said second element includes a web-plate connected to a web portion of the rail and said plate member being connected to said web-plate and extending longitudinally to opposite sides of said web-plate, and wherein there are two openings formed in said plate-like member as longitudinally extending slots with a first of said slots positioned to a fist side of said web-plate and a second of said slots positioned to an opposite side of said web-plate.

8. A rail fastening device as recited in claim 7, further comprising a second connecting element and a first of said connecting elements extends through said arm and through the first of said slots and a second of said two connecting elements extends through said arm and through the second of said slots.

9. A rail fastening device as recited in claim 8, further comprising a pair of pretensioned elements with a fist of said prestressed elements positioned on the first of said two connecting elements and in contact with said arm and a second of said prestressed elements positioned on the second of said two connecting elements and in contact with said arm.

10. A rail fastening device for fastening a longitudinally extending ratio to a support, comprising:

a first element having securement means for fixedly securing said fist element to the support and said first element having an arm extending off of the support;

a second element having connecting means for fixedly connecting said second element to said rail and said second element having a plate member extending essentially parallel to said arm, and said arm having an opening formed therein which is elongated in the longitudinal direction;

a connecting element which extends through the opening in said arm and is joined with said plate member so as to place said plate member and arm in frictional contact such that, upon an extension or contraction of the rail in the longitudinal direction and upon the frictional contact between said plate member and arm being overcome, said second element and the rail fixedly connected thereto are longitudinally displaced with respect to said first element which is fixedly secured to the support by said securement means.

11. A device according to claim 10, further comprising a prestressed element supported by said connecting element so as to permit longitudinal displacement of the rail upon a preestablished force being exceeded.

12. A device according t claim 11, wherein said prestressed element is at least one disk spring surrounding said connecting element.

13. A device according to claim 10, wherein said first element has at least two slot-shaped openings.

14. A device according to claim 10, wherein said arm of said first element includes a stepped shoulder and said second element includes a stepped shoulder which are engaged so as to prevent the rail from being lifted.

* * * * *